United States Patent [19]

Baker et al.

[11] Patent Number: 4,549,876

[45] Date of Patent: Oct. 29, 1985

[54] APPARATUS AND METHOD FOR HIGH SPEED FORMING A HINGED CARTON

[75] Inventors: Thomas R. Baker, Los Altos; William H. Hittenberger, San Mateo; Boris J. Posen, Los Altos, all of Calif.

[73] Assignee: Kliklok Corporation, Greenwich, Conn.

[21] Appl. No.: 432,412

[22] Filed: Sep. 30, 1982

[51] Int. Cl.[4] ..... B31B 3/60

[52] U.S. Cl. ..... 493/169; 493/173; 493/179; 493/422

[58] Field of Search ..... 493/139, 163, 169, 172, 493/173, 178, 179, 422, 423, 424, 425, 438; 53/48, 158

[56] References Cited

U.S. PATENT DOCUMENTS

| | | | |
|---|---|---|---|
| 1,531,882 | 3/1925 | Smith . | |
| 2,072,790 | 3/1937 | Apitzsch et al. | 493/423 X |
| 2,281,295 | 4/1942 | Nicodemus et al. . | |
| 3,105,418 | 10/1963 | Talbot et al. | 493/163 |
| 3,234,706 | 2/1966 | Arneson | 53/48 |
| 3,978,773 | 9/1976 | Pinto | 493/438 |
| 4,256,025 | 3/1981 | Goda et al. | 493/160 |
| 4,289,491 | 9/1981 | Collura et al. | 493/169 X |
| 4,299,590 | 11/1981 | Sasaki | 493/169 X |
| 4,424,658 | 1/1984 | Focke | 53/158 X |

*Primary Examiner*—John Sipos
*Assistant Examiner*—Steven P. Weihrouch
*Attorney, Agent, or Firm*—King, Liles & Schickli

[57] ABSTRACT

An apparatus and method for forming a hinged or clamshell type carton from a paperboard blank includes a feed conveyor for transferring the blank to a forming die. A hinge erecting conveyor is provided in the feed conveyor guide path to erect the hinge. A pair of pusher fingers form a shuttle conveyor in the guide path cooperating to transfer the partially erected blank to the die. Side channel guides arranged along the conveyor guide path maintain the partially erected paperboard blank in alignment with the erecting conveyor. Side channel guide extensions converge to maintain contacting engagement with the blank as selected carton panels converge during hinge formation and to support the blank in contacting registration on the face of the die and in the forming head path. A hinge gathering guide with hold down rails positioned above the erecting conveyor accurately locates and positions the carton blank and hinge. A folding assist blade and opposing registration post support the hinge over the die via engagement with the hinge tabs and serve to fold the tabs into the carton interior during the first part of the forming stroke. Erecting projections provided on the channel guide extensions fold the carton corner tabs into the carton interior. A reciprocating forming head descends into engagement with the blank and through the die to completely erect the carton.

17 Claims, 15 Drawing Figures

APPARATUS AND METHOD FOR HIGH SPEED FORMING A HINGED CARTON

TECHNICAL FIELD

This invention relates generally to carton forming and more particularly to an apparatus and method for high speed forming a clamshell type carton from a coated paperboard blank.

BACKGROUND OF THE INVENTION

Clamshell type cartons generally have two sections, each section including a base panel, wall panels attached to the base panel, and connecting tabs formed at the corners of the wall panels; the two sections being separated by an articulated hinge. Such cartons are useful, for example, as containers for fast food items such as hamburgers and the like. The paperboard from which the carton is formed is normally printed with attractive graphics and coated (with a polyethylene coating or the like) to protect the product and to prevent absorption of liquid or food juices by the paperboard.

Cartons of the clamshell type present one particularly difficult forming problem not present when simple trays are being formed. That is, some means must be provided to fold and gather the articulated hinge of the carton blank in a rapid manner while not interfering with folding and gluing steps. The carton blank must be conveyed into proper contacting registration with the forming die and must be properly supported in the forming head path to accept the onset of the forming head.

While this approach has proven to be successful, one disadvantage of this prior art type apparatus is that it has an upper speed limitation due to the relatively complex folding and gluing operations which must be performed in the forming die to provide the completed hinged, clamshell type carton. For example, the carrier frame utilized to feed the paperboard blank onto the die must pivot through 90° of movement into the forming head and must then pivot out of the die. Next, the hinge prebreaking blades must also pivot into and out of the die. The aforesaid feeding and blade movement must take place before the forming head begins its descending stroke. This built-in delay thus interferes with the high speed operation of the forming head, thereby increasing production time.

SUMMARY OF THE INVENTION

It is accordingly an object of the invention to provide an apparatus and method for more rapidly forming a clamshell type carton.

It is another object of the invention to provide apparatus and method for rapidly forming a clamshell type carton with conveying means for conveying a carton blank to a carton forming die in a rapid manner and for accurately preforming the hinge and locating the blank in contacting registration with the die.

Another object of the invention is to provide an apparatus and method for preforming the carton hinge by raising action of an endless conveyor during high speed conveyance to the forming die.

Still a further object is to support the hinge-formed and partially erected carton in contacting registration with the die and with tab prebreaking means located outside the forming head path.

Additional objects, advantages and novel features of the invention will be set forth in detail in part in the description which follows and in part will become apparent to those skilled in the art upon examination of the drawing, or may be learned by practice of the invention. The objects and advantages of the invention may be realized and obtained by means of the instrumentalities and combinations particularly pointed out in the appended claims.

The carton forming apparatus of the invention and the method for forming a hinged clamshell carton include a carton forming die for receiving the paperboard blank. The paperboard blank has two sections, each section including at least a base panel, wall panels attached to the base panel, and corner tabs formed at the corners of the wall panels, with the two sections separated by an articulated hinge, and hinge tabs formed adjacent the hinge. The die includes tab prebreaking and erecting surfaces located outside the forming head path to fold the tabs into position during the first part of the forming stroke. A folding assist blade and a rear registration post accurately locate the carton hinge over the die via engagement with the hinge tabs while also folding the hinge tabs into the required position.

A reciprocating shuttle conveyor transfers the paperboard blank into contacting registration with the die. The folding assist blade is positioned in the conveyor guide path. An endless conveyor upstream of the folding blade erects the hinge fold line while the carton is conveyed toward the die in a high speed, uninterrupted manner. The reciprocating forming head or plunger then forces the erected hinge carton blank into the die to fold and erect the wall panels of the carton.

The endless erecting conveyor includes a chain with raised fins gradually engaging and lifting the hinge fold to perform the pre-erecting function. The chain is timed so the lifting fins move at substantially the same speed as the carton, thereby eliminating any friction that could cause center lag of the carton.

The folding assist blade includes a pyramid-shaped cross-section with the leading edge being gradually elevated. A pair of hinge hold-down or positioning rails each having a pressing edge are positioned above the guide path to urge the hinge fold lines against the fins and the folding blade. This pressing engagement enables the cooperating folding fins and blade to raise the hinge without lifting the carton from the conveyor.

Side channel guides operatively positioned along the sides of the conveyor engage longitudinally extending wall panels of the carton to maintain the hinge fold line in alignment with the folding fins and blade. The side channel guides include converging guide channel extensions to provide continued supporting engagement to the wall panels as the width of the carton is reduced during hinge erection.

A final hinge gathering guide is positioned in alignment between the hold-down rails and includes a downwardly facing hinge gathering groove receiving the erected hinge. The guide maintains the hinge in longitudinal alignment for subsequent contacting registration of the carton with the die. The gathering guide also prevents the partially erected carton from flexing upwardly due to the combined effect of the erecting conveyor and the folding blade controlling the hinge formation. Once the carton is in position overlying the die, it is held down by the side channel guides.

The shuttle or transfer conveyor includes a carriage arrangement driven by a drive assembly to transfer the partially erected blanks to the die. The carriage includes a pair of pusher fingers engaging the trailing edges of the two sections of the carton. The fingers include shoulders and forwardly directed extensions to assist in the hold-down function and prevent upward bowing of the carton. The drive assembly is timed to shuttle the pusher fingers into position and take over moving the carton in a forward stroke to accomplish the transfer. As the carton is shuttled into a precise final position over the die under the guiding action of the side channel guide, the plunger may rapidly engage and cause the blank to enter the die to form the complete carton.

DETAILED DESCRIPTION

Figure 1:
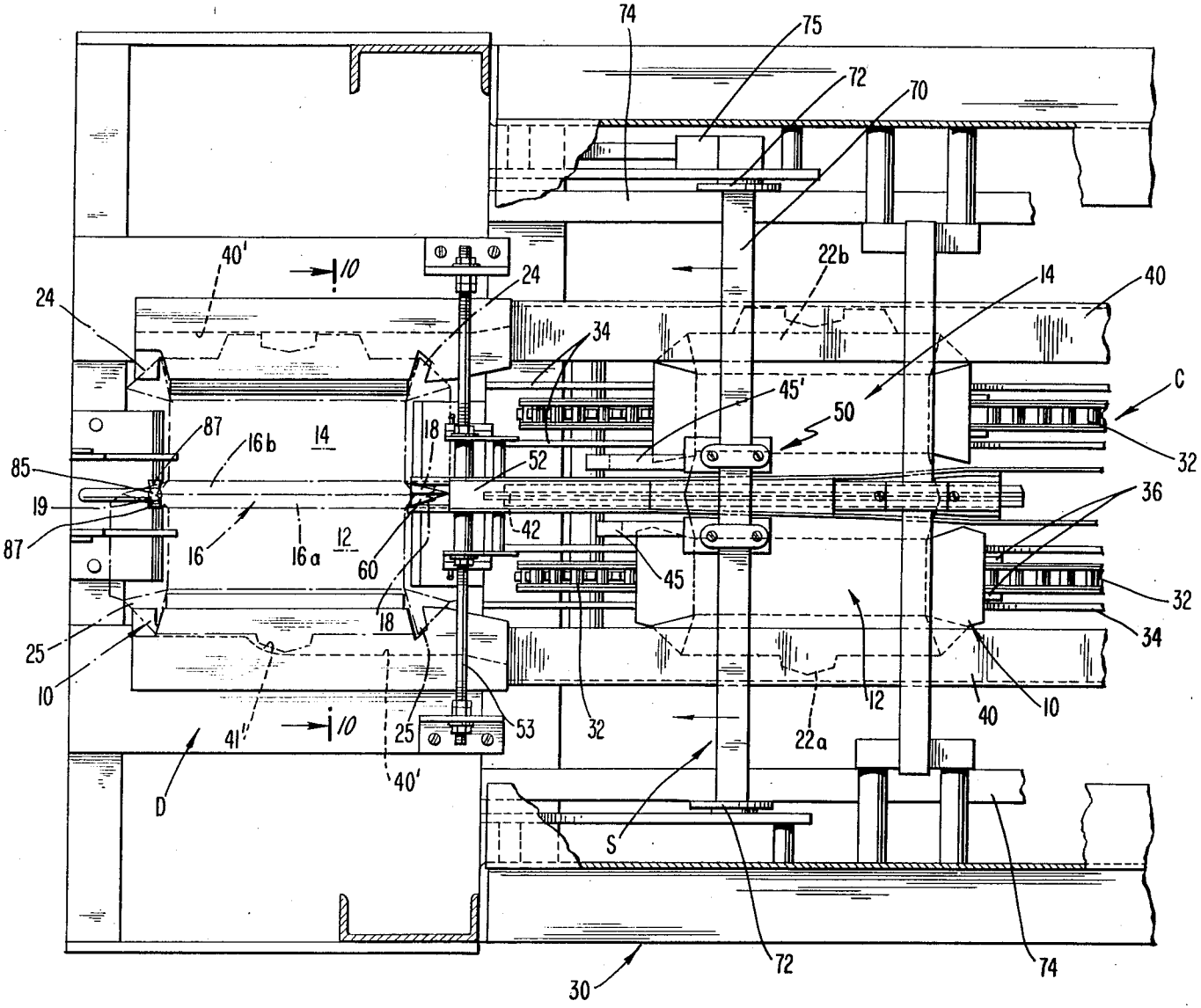
FIG. 1 is a top view of the carton forming apparatus showing the paperboard blank (full line outline) being conveyed toward the forming die on the conveyor, and in final position over the forming head path (dashed line)
Figure 12:
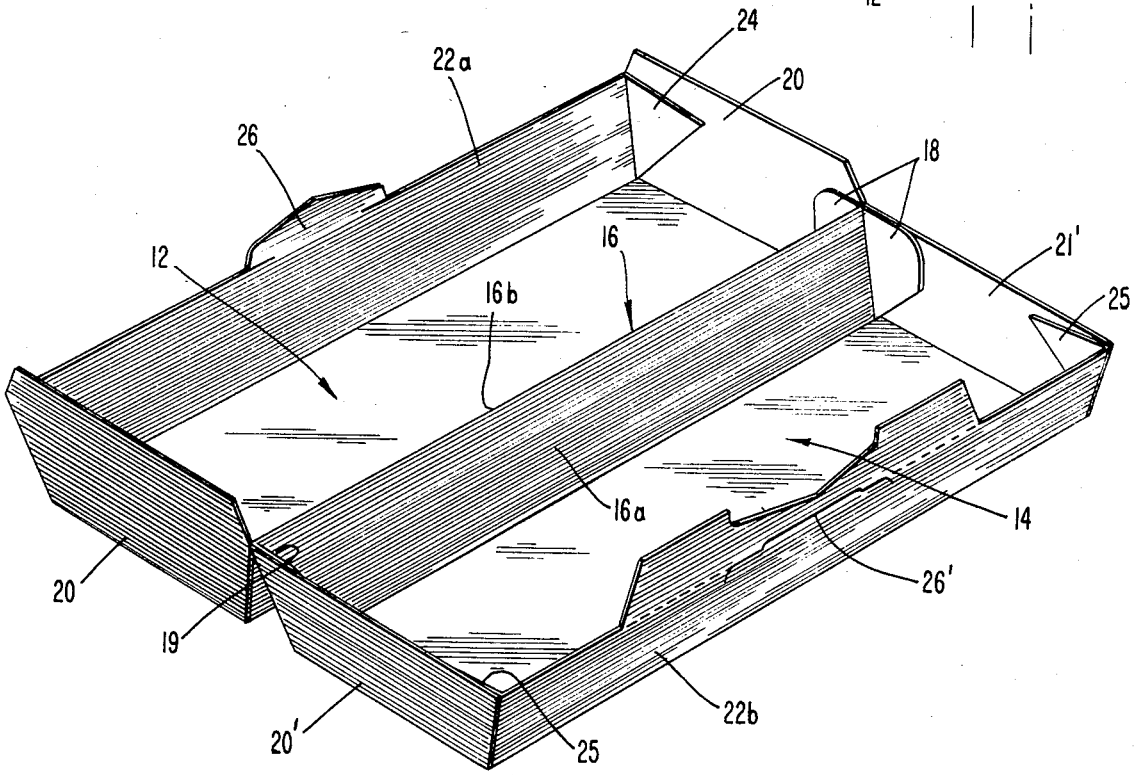
FIG. 12 is a perspective view of a fully erected clamshell type carton formed using the apparatus and method of the present invention.

Referring to FIG. 1, a preferred form of carton blank 10 for use with the apparatus of the invention includes a left hand base panel 12 and a right hand base panel 14 connected by a "living" or articulated hinge 16 (FIG. 12). Hinge 16 is formed by a scored fold line between a left hand hinge panel 16*a* and a right hand hinge panel 16*b*. Panels 16*a* and 16*b* are respectively attached to base panels 12 and 14 with scored fold lines therebetween, and also serve as inner side walls to the two halves of the finished carton (see FIG. 12). Hinge panels 16*a* and 16*b* each include a pair of hinged tabs 18, 19 formed on opposite ends thereof. A pair of end panels 20 and 20' are each respectively attached to base panels 12 and 14. Outer side wall panels 22*a* and 22*b* are respectively attached to the remaining side of base panels 12 and 14. Each side wall panel 22*a* and 22*b* respectively includes a pair of corner tabs 24, 25 formed between the side panel and adjacent end panel 20 and 20'. A locking tab, including a locking slit 26', is formed on the outer portion of right side panel 22*b*. Left side panel 22*a* includes a locking tongue 26 adapted to fit into locking slit 26' when the blank 10 is erected. Corner tabs 24 are sealed to their adjacent end panels by suitable adhesive. The dashed lines in FIG. 1 indicate prescored fold lines of the carton.

While the carton 10 is shown as an elongated carton extending in the direction of the hinge, it is clear that the principles of the present invention apply to the other clamshell carton shapes, such as square or elongated perpendicular to the hinge line.

It will be appreciated that a number of folding and gluing operations must be performed in order to form the paperboard blank of FIG. 1 into the completed, clamshell type carton shown in FIG. 12. In accordance with the invention, the fold lines between hinge panels 16*a* and 16*b* are first properly prebroken and then folded. Adhesive is then applied to areas of wall panels 20 and 20' adjacent hinge tabs 18 and corner tabs 24, and then the side and end walls of the carton must be folded and erected into the position shown in FIG. 12.

Figure 2:
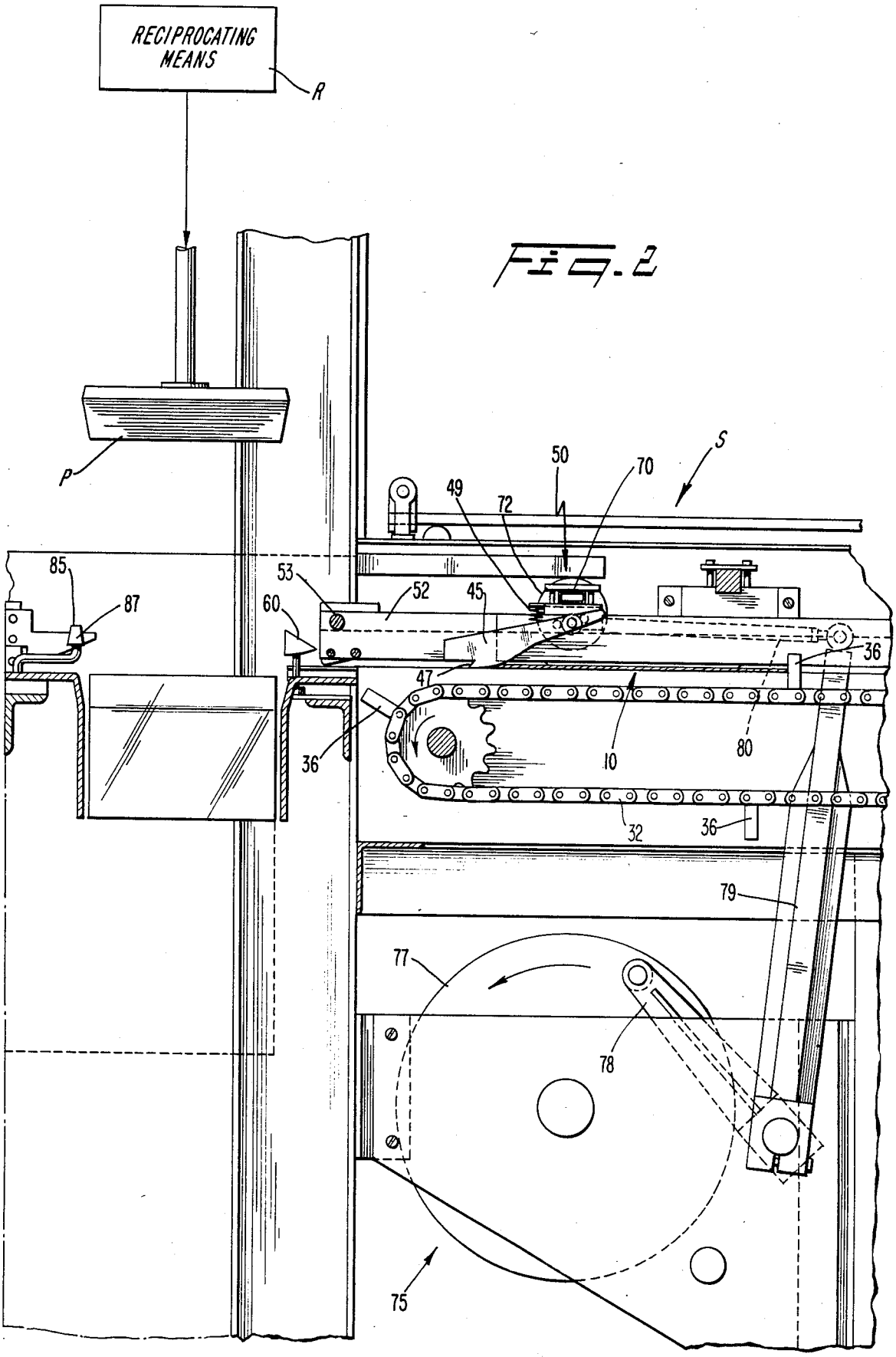
FIG. 2 is a side elevational view (partially in cross section) showing the operative location of the feed conveyor relative to the forming die and the shuttle conveyor used to convey the partially erected carton blank into contacting registration with the die.
Figure 3A:
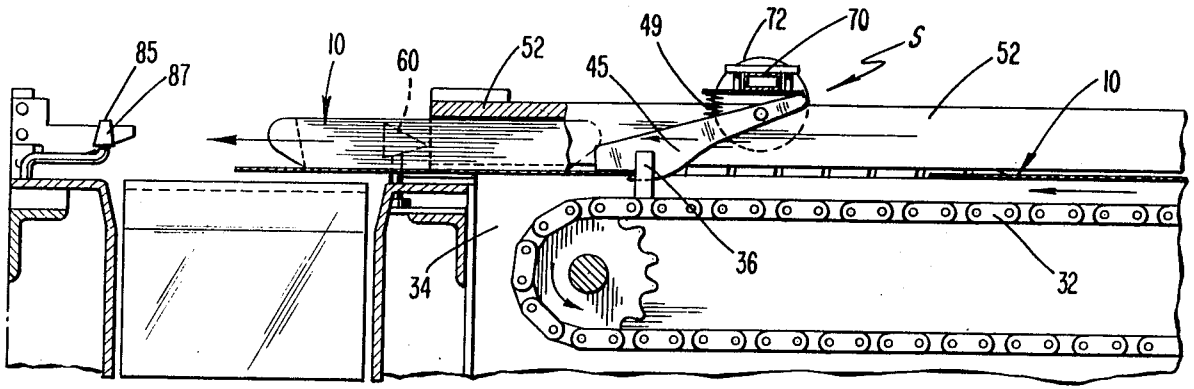
FIG. 3A is a partial, side elevational view similar to FIG. 2 but with the partially erected carton entering the forming head path under the guiding influence of the folding blade and the gathering guide while being under the influence of the shuttling action of the pusher fingers.

To carry out the aforesaid operations in a high speed and efficient manner, the carton forming apparatus of the invention, generally designated with reference numeral 30, utilizes a high input feed conveyor C to sequentially convey the cartons to a die assembly D where carton erection is completed. Input feed conveyor C, as best shown in FIGS. 1 and 2, includes a double chain drive comprising a pair of endless chains 32 trained around sprockets for constant velocity movement in the direction of die assembly D. A pair of stationary bottom rails 34 is provided on the sides of each chain 32. The bottom rails 34 project above endless chains 32 to define an even, continuous guide path for supporting carton blanks 10 travelling toward the die assembly. The upper edges of rails 34 are smooth and capable of engaging and supporting the carton base panels 12 and 14 in smooth, sliding relationship.

Each carton blank 10 is fed by conveyor C in uniform spaced relation from each other by pairs of lugs 36. Each pair of lugs 36 is attached to one of chains 32 in offset location from the other pair to accomodate the different lengths of the base panels 12, 14 (see FIG. 1), thus maintaining parallel alignment between the conveyor and the carton blank.

As shown in FIG. 1, a pair of lateral channel guides 40 extends longitudinally along the sides of the conveyor guide path so as to contact outer side panels 22*a* and 22*b*. Channel guides 40 are parallel and laterally spaced apart from each other to properly locate the central fold line of carton blank 10 in longitudinal alignment with a hinge erecting conveyor 42, (see e.g. FIG. 1), as discussed more fully below. In addition, guides 40 and extensions thereof advantageously serve to support and maintain the blank substantially flat for subsequent hinge articulation or "tenting" of the hinge, and subsequent registration with the die assembly, as hereinafter described.

Figure 11:
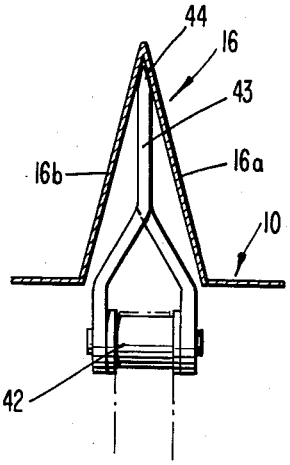
FIG. 11 is an enlarged detailed view of one fin element of the hinge erecting conveyor lifting the hinge upstream of the hinge gathering guide.

In accordance with the invention, hinge erecting or folding conveyor 42 is provided within the conveyor guide path to form articulated hinge 16. As best shown in FIGS. 1 and 3B–5B, conveyor 42 is centrally located between chains 32 and includes a plurality of fins 43 defining a smooth folding edge 44 that tapers upwardly along the guide path towards die assembly D so as to provide gradual bending engagement with the central fold line of blank 10. More specifically, composite folding edge 44 extends upwardly at a shallow angle to an elevational position above the guide path approximately equal to the height of hinge 16. The erecting conveyor 42 is driven at substantially the same speed as the feed conveyor C to assure a smooth, forward hinge bending and feeding action. The positive nature of the hinge forming action can be viewed in FIGS. 3B–5B (note the progressive erecting or folding of cartons 10). In FIG. 11, the manner in which the individual fins 43 engages the hinge 16 to lift and form the "tent" cross section is shown.

As shown in FIGS. 2 and 3A–5A, a pair of hinged pusher fingers 45 and 45' are provided to form a shuttle conveyor S to move the blank from engagement with the feed conveyor C and onto the face of the forming die. Each finger 45 and 45' is pivotally mounted to an overhead carriage 50, to be described hereinafter, in corresponding and laterally spaced position. A forwardly facing tapered shoulder 47 is provided on each finger to engage the trailing edge of the carton and feed it forwardly. The shoulder 47 projects slightly below the plane of carton travel under the compression force of a spring 49. The lower edge projects into the blank feed path. When the shuttle conveyor S starts its return to the home position (FIG. 5A) toward the oncoming blank 10 (FIGS. 2 and 5A), the fingers 45 are lifted to exert gentle yet positive pressing contact on hinge panels 12 and 14 adjacent the central fold lines. This important feature of the invention helps assure smooth continuation of the positive hinge formation while transferring the carton blank from the feed conveyor C to the die D.

As best shown in FIGS. 1 and 3, carriage 50 comprises a transverse support bar 70 carrying the spring loaded fingers 45, 45' with brackets. Support bar 70 extends above the conveyor path and includes roller guides 72 rotatably mounted on opposite ends thereof. Guides 72 engage side rails 74 extending longitudinally on either side of conveyor C.

A drive assembly 75 imparts the necessary shuttling movement to fingers 45 and 45' via the carriage 50. As shown in FIG. 2, drive assembly 75 includes a drive wheel 77 and lever 78 and rods 79, 80 suitably sized and operatively connected to impart the desired degree of reciprocating movement.

Figure 10:
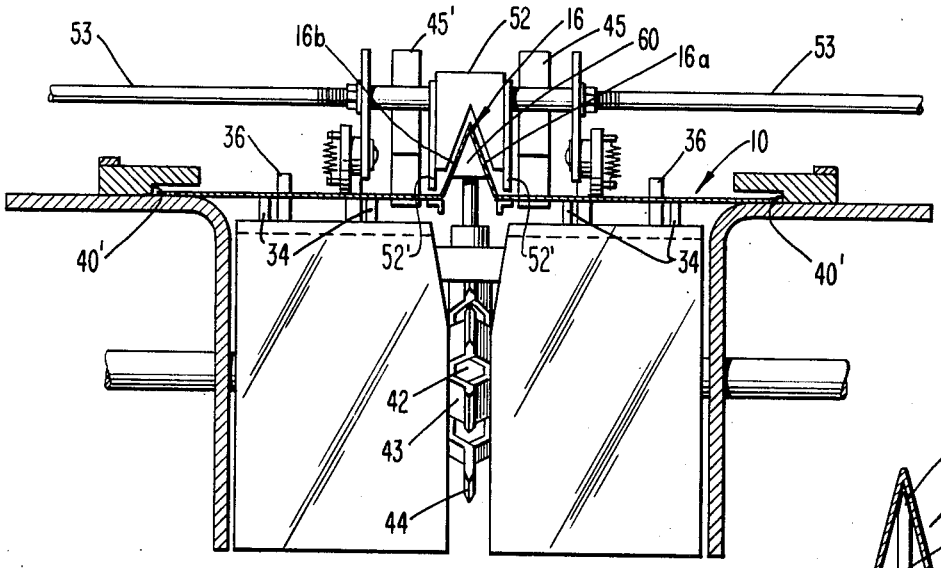
FIG. 10 is a view taken through the line 10—10 of FIG. 1 showing the partially erected carton in final position over the forming die in supporting engagement with side channel guides and the gathering guide located outside the path of the forming head.

To prevent the "tented" carton blank from flexing upwardly due to the natural resistance to bending of the paperboard, or as is known in the art as "memory" of the blank, a hinge gathering guide 52 is statically mounted directly above hinge erecting conveyor 42 by transverse support bars 53 and includes a downwardly facing inverted V-shaped channel and outer hold down rails 52'. The hinge gathering guide advantageously captures and maintains the elevational, as well as the lateral alignment of hinge 16 forming on the hinge conveyor 42 (FIG. 10).

Converging guide extensions 40' are provided adjacent the entrance to the forming die D, as best shown in FIGS. 1 and 6–9. As hinge 16 is raised to its full height on the fins 43 of the conveyor 42, it will be appreciated that the transverse width of carton 10 is thereby reduced (see arrows A and A' in FIGS. 7 and 8). The guide extensions 40' advantageously serve to provide continued smooth supporting engagement to the convering outer panels **22*a* and 22*b* as the hinge 16 is erected. Positive inward camming action by the extensions 40' on the blank 10 is also present. The partially formed blank 10 is then held inwardly at the proper width dimension in the direction of arrows A, A' (FIG. 8) in readiness for the forming action. As with the side channel guides 40, the blank 10 is also held against flexing and popping out of position by the upper and lower rails forming the channel. A stop portion 41' on one of the rails 40' is also provided (see FIGS. 1 and 9**) to assist in accurately stopping the blank in the longitudinal direction.

The conveyor system C in combination with the erecting conveyor 42 and channel guide arrangement 40, 40' hereinabove described constitutes an important feature of the invention. The hinge folding and gathering is accurately and controllably performed while the carton blank 10 is being conveyed to the die. In this manner, reliable and high speed carton transfer and hinge erection can occur during the straight line blank conveyance to the die. This unique arrangement eliminates the prior use of slower, multi-directional carton feed movement provided by the carton blank carrier frame described in the aforementioned prior art. Our invention further avoids the need for successive hinge folding operations with pivotal folding blades that require retraction out of the forming head path.

Carton forming apparatus 30 of the invention also includes additional unique means for assisting in the transferring of the hinged carton blanks 10 from conveyor C into proper registration with die assembly D where the carton is fully erected. As shown in FIGS. 1 and 3–5, a forward folding assist blade 60 is provided slightly downstream from erecting conveyor 42. Assist blade 60 is substantially pyramid shaped and includes a pair of triangular guide faces **60*a*, 60*b* (see FIG. 6). The guide faces 60*a* and 60*b* converge upwardly away from the die D from a triangular base. The apex defines a hinge supporting point as shown in FIG. 10. Faces 60*a*, 60*b* enable the forward tabs 18 to bend toward the respective panels 20, 20' to assure proper inward folding during the first portion of the downward movement of forming plunger P (note FIGS. 4A and 5A). The vertical cross sectional shape of folding assist blade 60 (see FIG. 10) is triangular and corresponds to the sectional shape of hinge 16. Blade 60 is located to gradually engage the underside of the entire hinge 16 entering the die D. In this manner, blade 60 serves to accurately assist the center forming of hinge 16 as carton 10** enters the forming die and comes to a stop.

The partially erected carton 10 enters over the forming die assembly D under the guiding action of blade 60 and the converging channel extensions 40'. As carton blank 10 is shuttled into final position over the die, the locking tongue 26 contacts the stop portion 41' provided in the corresponding channel extension 40' and stops in registry in readiness for the downward movement of the plunger P (see FIGS. 8 and 9).

As shown in the drawings, rear registration post 85 is attached to die assembly D and is located outside the forming head path to contact the undersides of hinge tabs 19. Ears 87 are provided on post 85 in physical contact with the hinge tabs and serve to lift the tabs 19 clear of the end wall panels 20 and 20' during the descending forming stroke. In this way, ears 87 assure that hinge tabs 19 are folded to lie within the interior of carton blank 10 in adhesive fastening engagement with the carton end walls. Similarly, guide faces 60*a*, 60*b* physically contact the hinge tabs 18 to assure that the tabs are also folded into the carton interior. The adhesive bonding between the tabs 18, 19; 24, 25 and the corresponding panels may be in any suitable known manner, such as adhesive dots applied in the sealing area, or heat activated adhesive areas.

Figure 4A:
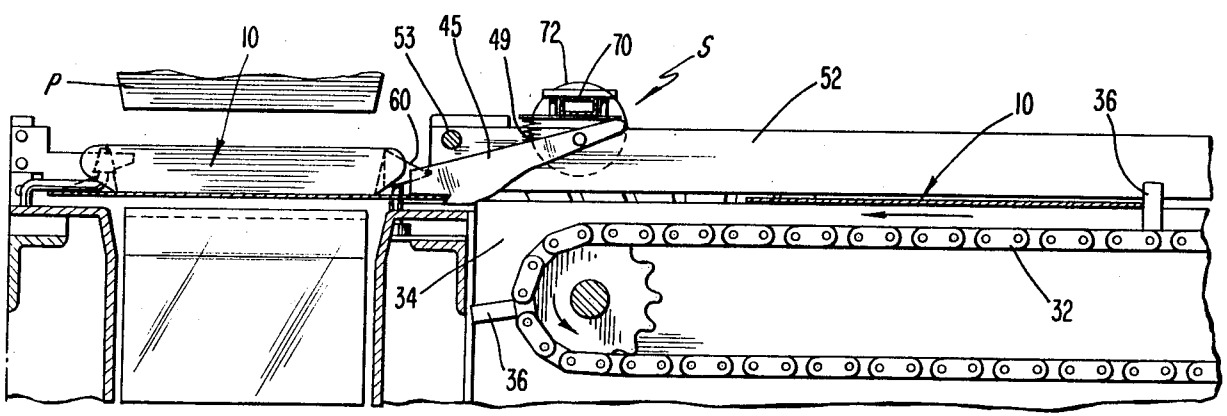
FIGS. 4A and 4B are similar to FIGS. 3A and 3B showing the partially erected carton in final position over the forming head cavity awaiting the onset of the forming head.
Figure 9:
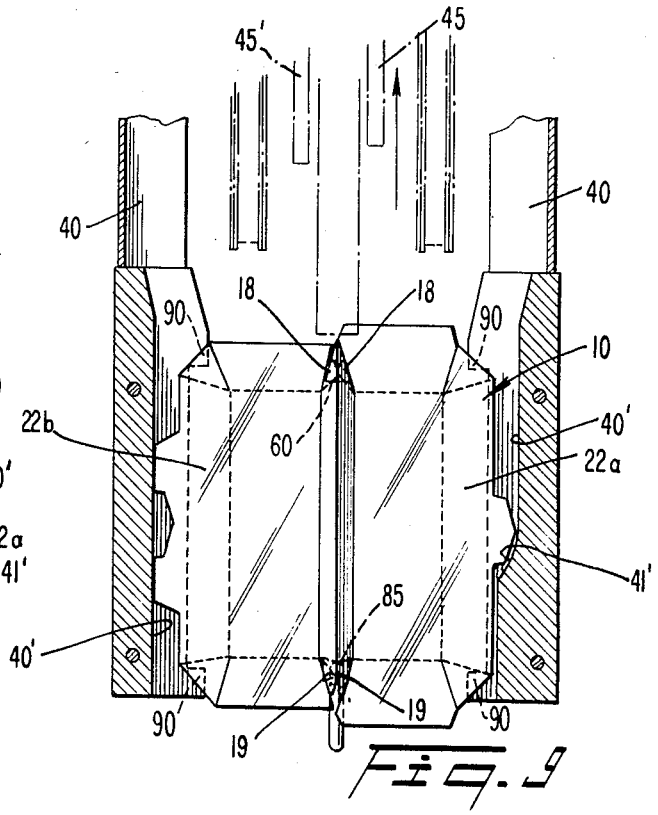

In FIGS. 4A, 9 and 10, the partially erected carton blank 10 is shown aligned in registration with the upper surface of die assembly D receiving the descending plunger or head P driven by reciprocating means R. As shown in FIGS. 1 and 9, it can be seen that corner tabs 24, 25 of the carton 10 overlie horizontally, extending projections 90 of guide extensions 40'. Projections 90, located outside the forming head path, serve as corner posts to lift the tabs 24, 25 so that they are folded into the carton interior.

Figure 5A:
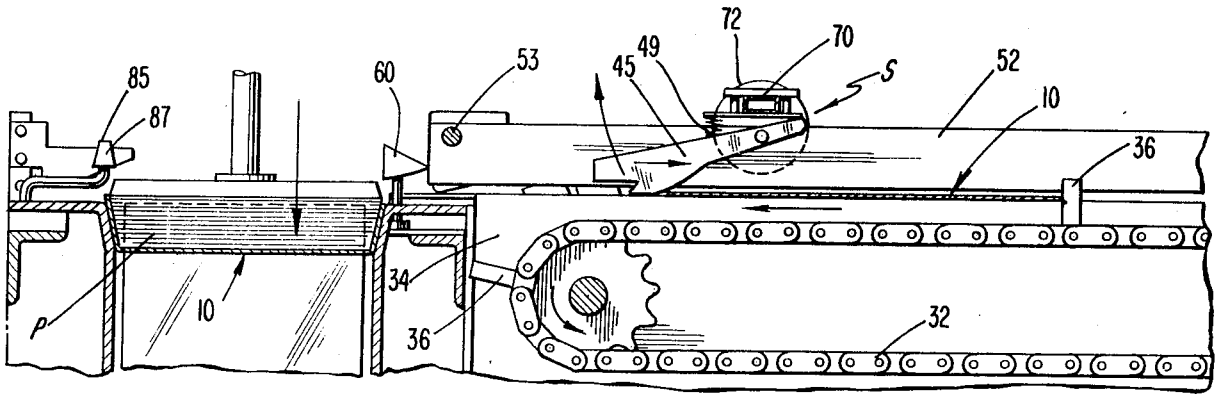
FIGS. 5A and 5B are similar to FIGS. 4A and 4B, but showing the forming head now engaging the paperboard blank to fully erect the carton.
Figure 3B:
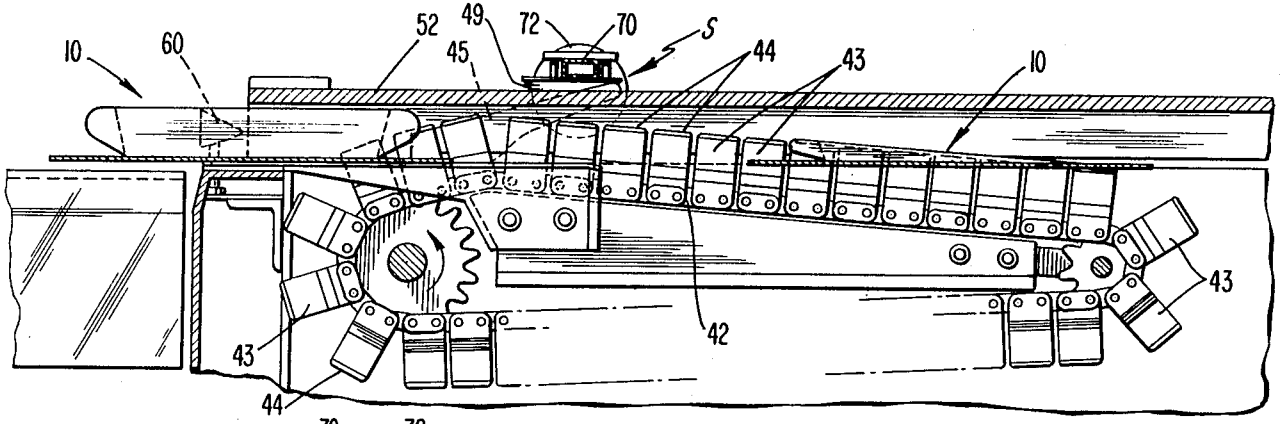
FIG. 3B showing the same view but having parts removed to illustrate the underlying hinge erecting conveyor.
Figure 4B:
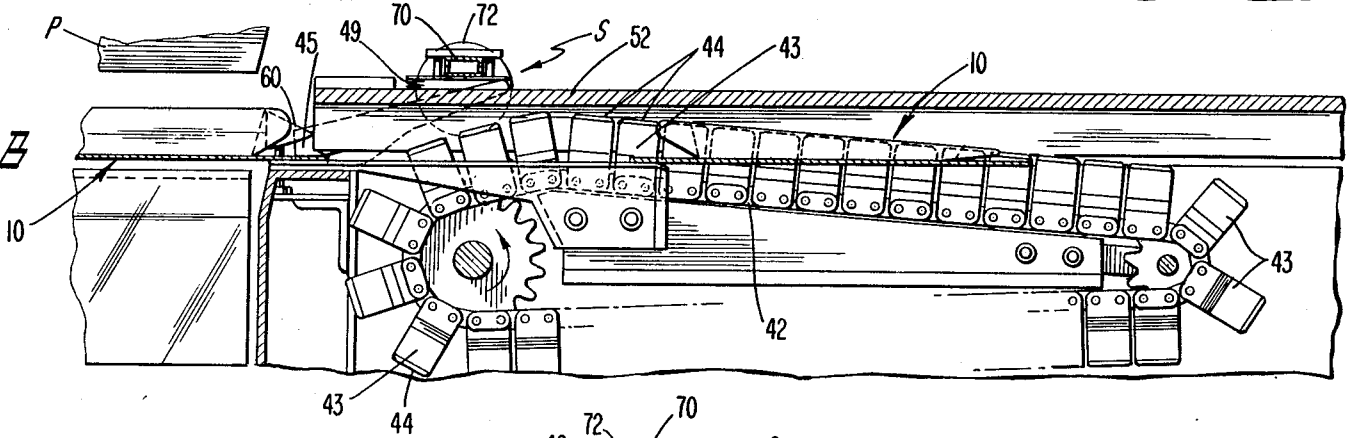
Figure 5B:
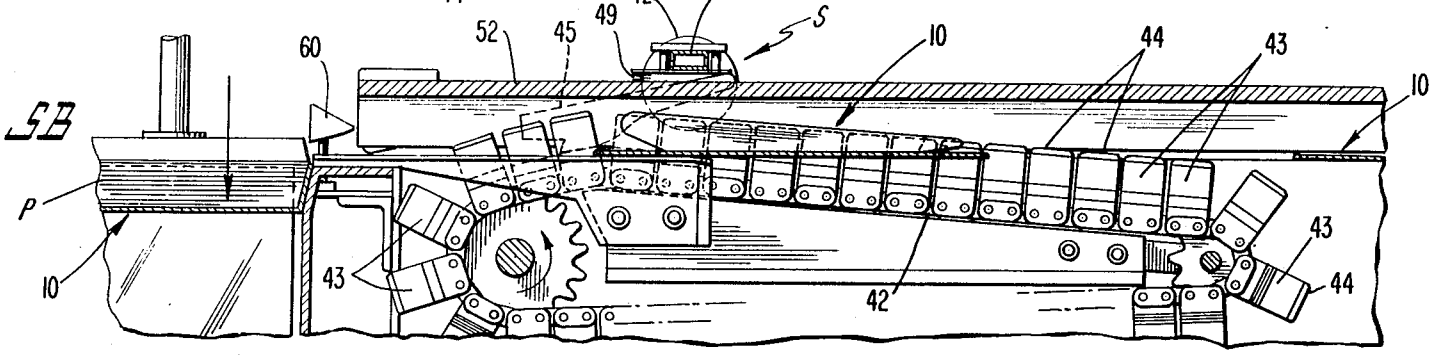
Figure 6:
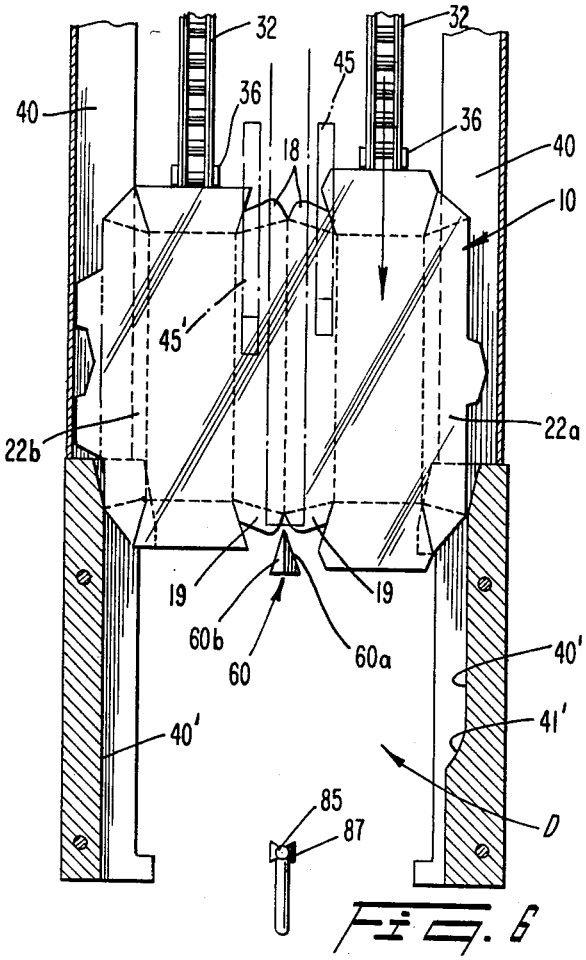
FIGS. 6–9 are partial top views also sequentially illustrating hinge erection on the conveyor, convergence of the carton panels under the guiding action of the side channel guides, and shuttling movement of the partially erected carton into final position over the forming head cavity.
Figure 7:
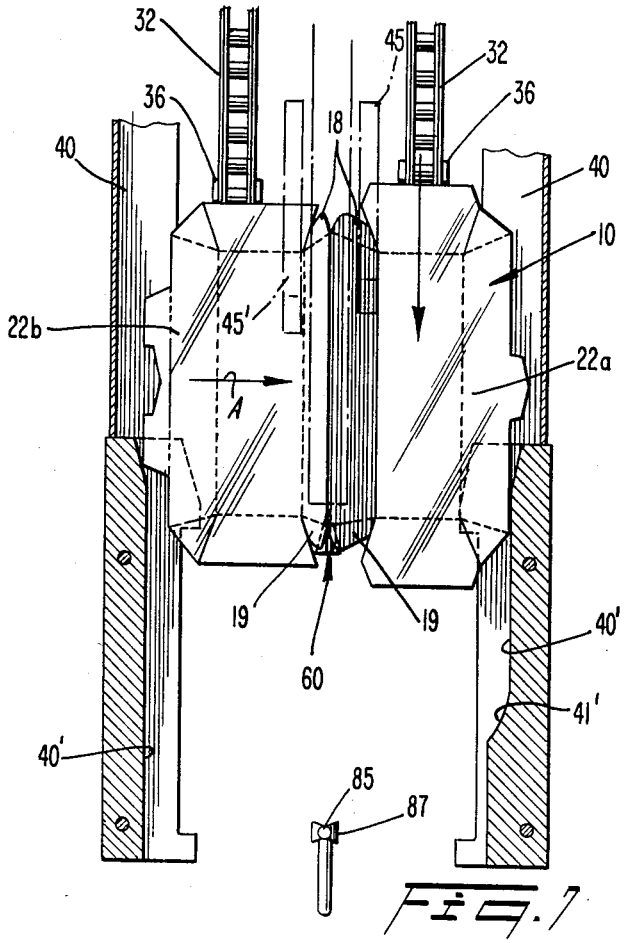
Figure 8:
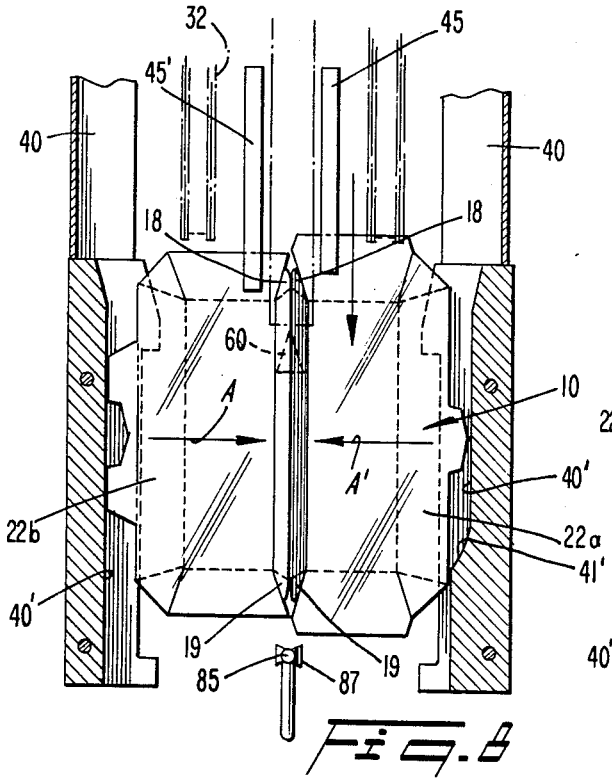

In operation, forming head P is actuated to move downwardly into contact with the upper surface of carton blank 10 disposed over die D, as shown in FIG. 5A. The downward motion of forming head P forces the carton blank 10 into the mouth of the die D with corner tabs 24, 25 being initially folded and erected through contact with projections 90. Similarly, the forward and rear hinge tabs 18, 19 are erected through contact respectively with folding blade 60 and with ears 87 on the post 85. As carton blank 10 is further urged into die D, side and end panels 20, 20' and 22*a*, 22*b* are erected. When carton 10 is fully erected, corner tabs 24, 25 and hinge tabs 18, 19 are disposed adjacent and in contact with previously applied/activated adhesive.

When forming head P reaches its lowest point of travel with respect to die D, the erected carton is ejected and can enter a stacking cage (not shown) that receives and retains the erected cartons in a nested fashion.

It can thus be seen that the present invention has many advantages over other types of apparatus for forming a clamshell type carton. Hinge folding is performed rapidly and accurately in the movement conveying the carton blank 10 to the die D in a high speed and uninterrupted manner. The pusher fingers 45 and 45' serve as a shuttle conveyor to move the blanks into position at the die D. Cooperation between the folding assist blade 60, the side channel guides 40 and 40', the projections 90 and the registration post 85 accurately locate and position the carton blank 10 over the forming die in cantilevered fashion so as not to require support means positioned in the forming head path that must be removed prior to forming head movement. The carton folding apparatus is thus designed for maximum speed and versatility for forming a clamshell type carton.

While the carton forming apparatus of the present invention has been described in considerable detail, it is understood that various changes and modifications may occur to persons of ordinary skill in the art without departing from the spirit and scope of the appended claims.

We claim:

1. Apparatus for forming a clamshell type carton from a free paperboard blank or the like along a substantially horizontal path, the carton having two sections, each section including at least a base panel, wall panels attached to the base panel, and corner tabs formed at the corners of the wall panels, the two sections separated by an articulated central hinge, and hinge tabs formed adjacent the hinge, comprising:

(a) a carton forming die for receiving said free paperboard blanks and for erecting and retaining selected panels of said carton by the adjacent tabs;

(b) means for conveying the paperboard blank along a substantially rectilinear guide path into contacting registration with the die;

(c) upstanding means for prebreaking and erecting said articulated hinge along said guide path during movement of said blank before said carton blank reaches the die, said prebreaking and erecting means being positioned upstream from the die adjacent said conveying means; and (d) a hinge gathering guide along said guide path including hold down rails and downwardly facing hinge gathering groove means positioned to overlie and contact the central hinge of said free paperboard blank and urge the panels adjacent the central hinge fold line down against said upstanding means to thereby enable erection of the hinge without lifting the carton from the conveyor guide path; and (e) a reciprocating forming head for forcing the erected hinged carton blank into said die immediately upon proper registration of the blank on said die so as to rapidly fold and erect said wall panels of said carton.

2. Apparatus according to claim 1, wherein said conveying means includes a shuttling means sequentially conveying the paperboard blanks with the hinge in longitudinal alignment on the conveyor.

3. Apparatus according to claim 2, wherein said hinge erecting means includes a hinge erecting conveyor having upstanding fins operatively positioned in the conveyor guide path to progressively engage a central fold line of the hinge, thereby erecting the hinge.

4. Apparatus according to claim 3, further including side channel guides operatively positioned along the sides of the conveyor guide path, said guides engaging longitudinally extending wall panels of the carton to maintain the hinge fold line in longitudinal alignment with the erecting means.

5. Apparatus according to claim 4, further including a hinge gathering guide including hold down rails positioned to urge the panels adjacent the hinge fold lines down to thereby enable erection of the hinge without lifting the carton from the conveyor guide path.

6. Apparatus according to claim 5, further including converging side channel guide extensions, said converging extensions being operable to provide continued supporting engagement to the wall panels as the width of the carton is reduced during hinge erection.

7. Apparatus according to claim 4, wherein a pair of channel guide extensions are provided on the upper surface of the die in longitudinal alignment with the conveyor side channel guides, at least one of the channel guide extensions including a converging portion operable to assist in forming said hinge.

8. Apparatus according to claim 2, wherein said shuttling means includes a drive assembly and a carriage supporting a pair of pusher fingers in the guide path, said pusher fingers each having a shoulder engageable with a trailing edge of the carton, said drive assembly being timed to drive the carriage arrangement and fingers in reciprocating movement to transfer the carton into the die.

9. Apparatus according to claim 1, wherein a folding assist blade is provided between said erecting means and said die to receive and guide the erected carton hinge in supporting and guiding engagement to thereby maintain the hinge in a centered position and to properly direct the carton into the die.

10. Apparatus according to claim 9, wherein said assist blade is substantially pyramid shaped and includes a cross section corresponding to the cross-sectional shape of the hinge, said blade being further positioned to engage the undersides of the hinge tabs during the forming operation to support the carton in contacting registration over the die and to fold upstream hinge tabs into the carton interior during the first part of the forming stroke.

11. Apparatus according to claim 10, further including a registration post operatively positioned to support the opposite end of the carton hinge when the carton is in final position over the die, said post having ear projections engaging the undersides of the hinge tabs to thereby fold the same into the carton interior during the first part of the forming stroke.

12. Apparatus according to claim 11, wherein a pair of channel guide extensions are provided including horizontally extending erecting projections beneath the carton corner tabs in contacting registration therewith when the carton is in position over the die, said erecting projections thereby folding the corner tabs into the carton interior during the first part of the forming stroke.

13. Apparatus for forming a clam-shell type carton from a free paperboard blank or the like along a substantially horizontal path, the carton having two sections, each section including at least a base panel, wall panels attached to the base panel, and corner tabs formed at the corners of the wall panels, the two sections separated by an articulated hinge, and hinge tabs formed adjacent the hinge, comprising:

(a) a carton forming die for receiving said free paperboard blanks and for erecting and retaining selected panels of said carton by the adjacent tabs;

(b) means for conveying the paperboard blank along a substantially rectilinear guide path into contacting registration with the die;

(c) upstanding means for prebreaking and erecting said articulated hinge along said guide path during movement of said block before said carton blank reaches the die, said prebreaking and erecting means being positioned upstream from the die adjacent said conveying means;

(d) a hinge gathering guide positioned in longitudinal alignment above the erecting means, said gathering guide having a downwardly facing hinge gathering groove cooperating with said upstanding erecting means to urge the panels adjacent the articulated hinge down against said upstanding means and to receive the erected hinge during folding, thereby maintaining the hinge in longitudinal alignment with the erecting means for subsequent contacting registration of the carton with the die; and (e) a reciprocating forming head for forcing the erected hinged carton blank into said die immediately upon proper registration of the blank on said die so as to rapidly fold and erect said wall panels of said carton.

14. A method for forming a clam-shell type carton from a free paperboard blank or the like, the carton having two sections, each section including at least a base panel, wall panels attached to the base panel, and corner tabs formed at the corners of the wall panels, the two sections separated by an articulated hinge, and hinge tabs formed adjacent the hinge, comprising the steps of:

(a) conveying the free paperboard blank along a substantially rectilinear guide path in the direction of a forming die;

(b) erecting the carton hinge as the free blank is conveyed past upstanding erecting means toward the forming die;

(c) holding the carton down along the conveyor guide path during conveying and erecting by means of hold down rails and downwardly facing hinge gathering groove means overlying and contacting the carton hinge and urging the panels adjacent the articulated hinge down against said upstanding means thereby maintaining the hinge in longitudinal alignment with the erecting means for subsequent contacting registration of the carton with the forming die;

(d) transferring the partially erected carton from the conveyor into contacting registration with the forming die;

(e) supporting the partially erected carton in final position over the forming die in the forming head as a cantilevered structure; and (f) forming the blank into a completely erected carton.

15. A method according to claim 14, comprising the further step of accurately positioning the carton hinge in longitudinal alignment for forming while the carton is conveyed to the folding means.

16. A method according to claim 14, comprising the further step of forming the carton by plunging the partially erected carton through a forming die with the panels of the carton converging toward each other.

17. A method according to claim 14, comprising the further step of holding the panels adjacent a central hinge fold line in a downward direction while the carton hinge is progressively raised, thereby preventing the carton from lifting out of the guide path during hinge formation.

* * * * *